US006634336B1

(12) United States Patent
Kropp

(10) Patent No.: US 6,634,336 B1
(45) Date of Patent: Oct. 21, 2003

(54) PRESSURE BOOSTER AND FUEL INJECTION SYSTEM WITH A PRESSURE BOOSTER

(75) Inventor: Martin Kropp, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 204 days.

(21) Appl. No.: 09/869,520

(22) PCT Filed: Oct. 12, 2000

(86) PCT No.: PCT/DE00/03596

§ 371 (c)(1),
(2), (4) Date: Dec. 14, 2001

(87) PCT Pub. No.: WO01/33067

PCT Pub. Date: May 10, 2001

(65) Prior Publication Data

(65)

(30) Foreign Application Priority Data

Oct. 30, 1999 (DE) ..... 199 52 512

(51) Int. Cl.[7] ..... F02M 41/00

(52) U.S. Cl. ..... 123/467; 123/446; 123/447

(58) Field of Search ..... 123/467, 447, 123/446; 239/88, 89, 91, 533.2, 533.3, 533.9, 585.1, 585.5; 251/129.15, 129.21, 127

(56) References Cited

U.S. PATENT DOCUMENTS

| | | | | | |
|---|---|---|---|---|---|
| 4,344,406 | A | * | 8/1982 | Minor et al. | 123/587 |
| 4,691,674 | A | * | 9/1987 | Otsuka et al. | 123/299 |
| 4,784,101 | A | * | 11/1988 | Iwanaga et al. | 123/446 |
| 5,368,068 | A | * | 11/1994 | Hunsberger et al. | 137/493.7 |
| 5,407,174 | A | * | 4/1995 | Kumar | 251/129.08 |
| 5,622,152 | A | * | 4/1997 | Ishida | 123/446 |
| 5,865,156 | A | * | 2/1999 | Feucht et al. | 123/446 |

FOREIGN PATENT DOCUMENTS

| | | | |
|---|---|---|---|
| JP | 59141764 | * | 8/1984 |
| RU | 2074975 C1 | * | 3/1997 |
| RU | 2078244 C1 | * | 4/1997 |
| WO | WO9612109 | * | 4/1996 |

* cited by examiner

*Primary Examiner*—Mahmoud Gimie
(74) *Attorney, Agent, or Firm*—Ronald E. Greigg

(57) ABSTRACT

A pressure booster for increasing the injection pressure in direct-injection internal combustion engines with a plurality of cylinders, in particular diesel engines, having a booster piston which has a relatively large end face that is subjected to a relatively low pressure and a relatively small end face at which in the pumping stroke an elevated injection pressure prevails, wherein on the side remote from the relatively large end face, because of the difference in size between the two end faces of the booster piston, an idle volume results. The idle volume is in communication with a cantilevered spring reservoir disposed locally for each individual cylinder or centrally for all the cylinders of the engine.

6 Claims, 1 Drawing Sheet

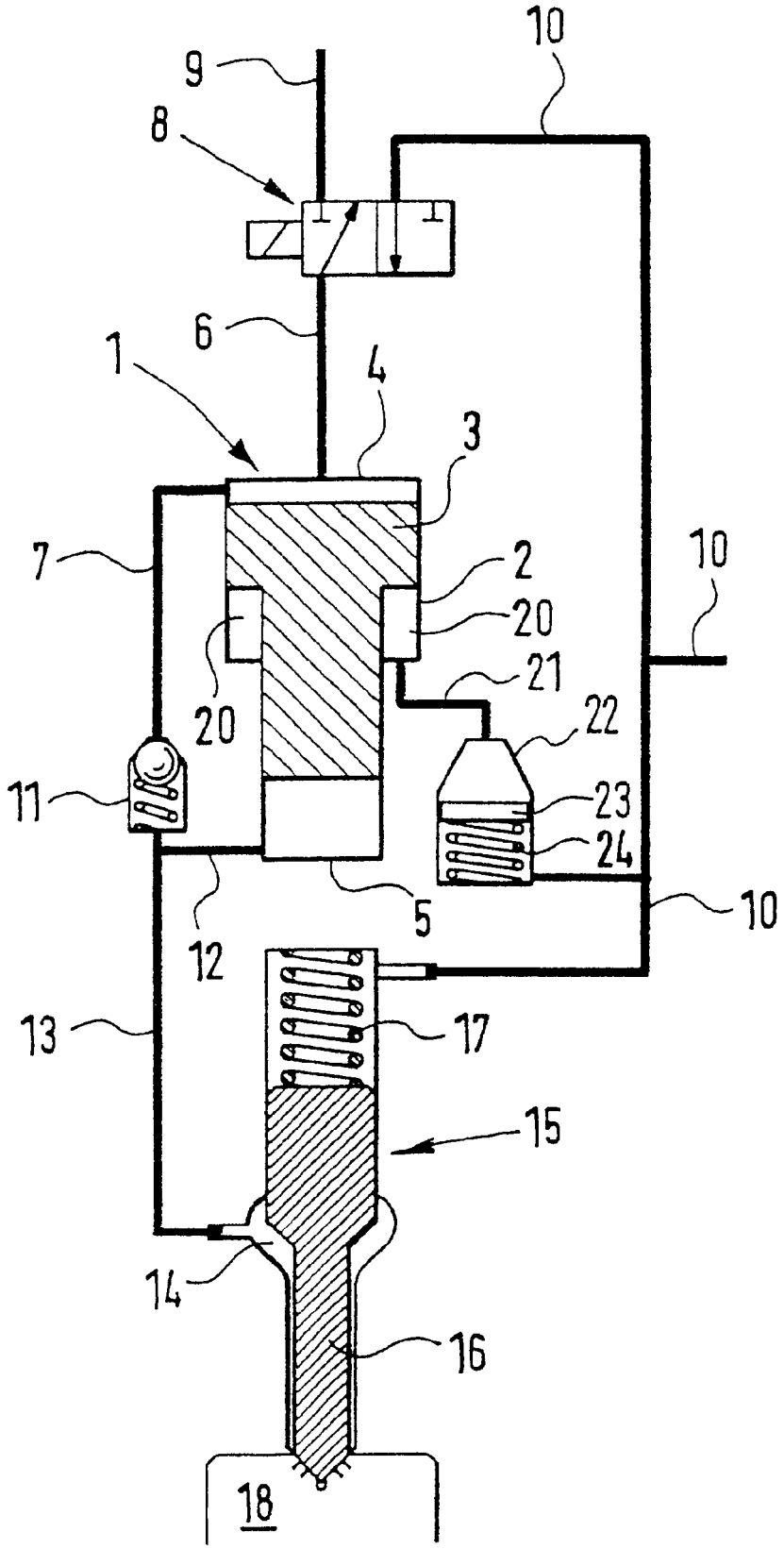
10
9
8
6
1
4
3
7
2
10
20
20
21
22
11
23
24
12
5
10
13
17
15
14
16
18

PRESSURE BOOSTER AND FUEL INJECTION SYSTEM WITH A PRESSURE BOOSTER

CROSS-REFERENCE TO RELATED APPLICATIONS

This application is a 35 USC 371 application of PCT/DE 00/03596 filed on Oct. 12, 2000.

BACKGROUND OF THE INVENTION

1. Field of the Invention

The invention relates to a pressure booster for increasing the injection pressure in direct-injection internal combustion engines with a plurality of cylinders, in particular diesel engines, having a booster piston which has a relatively large end face that is subjected to a relatively low pressure and a relatively small end face at which in the pumping stroke an elevated injection pressure prevails, wherein on the side remote from the relatively large end face, because of the difference in size between the two end faces of the booster piston, an idle volume results. The invention also relates to a fuel injection system, in particular a common rail system, with a high-pressure connection that communicates with an injector, from which fuel is injected into the combustion chamber of an internal combustion engine.

2. Description of the Prior Art

For introducing fuel into direct-injection diesel engines, both pressure-controlled injection systems (German Patent Disclosure DE 197 06 467 C1) and stroke-controlled injection systems (DE 196 19 523 A1) are known. It is advantageous if the injection pressure is adapted to the load and rpm, as can be the case in a common rail system.

In common rail injection systems, a high-pressure pump, optionally with the aid of a prefeed pump, pumps the fuel to be injected out of a tank into the central high-pressure fuel reservoir, also known as a common rail. From the rail, fuel lines leads to the individual injectors, which are assigned to the engine cylinders. As a function of the operating parameters of the engine, the injectors are triggered individually by the engine electronics in order to inject fuel into the combustion chamber of the engine. The maximum injection pressures in common rail systems are currently limited, by the high-pressure strength of pressure reservoirs and high-pressure pumps, to about 1600 to 1800 bar. To increase the injection pressure still further, injection systems with pressure boosters are employed.

One such common rail system is described for instance in European Patent Disclosure EP 0 562 046 B1. This involves a pressure-controlled common rail system with a pressure booster (high boosting ratio of approximately 1:7). As in every pressure-boosted injection system, here as well there is an idle volume, in which a restoring spring is disposed. The idle volume communicates with a leakage line via a (springless) check valve. This has the advantage that the quantity positively displaced during the pumping stroke need not be reaspirated from the leakage line upon restoration of the booster piston. A disadvantage, however, is that the fuel located in the idle volume cavitates during the restoration. When the cavitation bubbles pop, they generate additional noise.

Upon activation of the pressure boosting, an increased injection pressure during the pumping stroke is obtained, because of the different ratios of the areas of the faces of the pressure booster piston. Once the injection has ended, the booster piston must return to its outset position (refilling). To that end, usually the low-pressure side of the piston is relieved, and the piston is pressed back into its outset position because of the balance of forces at the piston. During the return motion, the high-pressure chamber of the pressure booster must be filled with fuel. If this is accomplished only with the aid of a prefeed pressure, then at high pressure boosting ratios an additional restoring spring is necessary, since the resultant force at the high-pressure face is not sufficient to overcome the forces of friction at the piston. To achieve restoration without a restoring spring, a high pressure would be needed on the high-pressure side, but this pressure would have to be generated additionally, which would mean a considerable additional expense. In principle, the restoring spring can be mounted in any of the three chambers (idle chamber, high-pressure chamber and low-pressure chamber). Where the spring or springs is disposed depends on the type of piston (in one or two parts) and the installation space available. In low-pressure side relief actions in "mixed operation", restoring springs also increase the restoration speed.

At low pressure boosting ratios, it is problematic to integrate a restoring spring of a suitable stroke-force course, since the installation space is highly limited.

The object of the invention is to disclose provisions which assure adequate, rapid refilling of the pressure booster even at low pressure boosting ratios.

SUMMARY OF THE INVENTION

In a pressure booster for increasing the injection pressure in direct-injection internal combustion engines with a plurality of cylinders, in particular diesel engines, having a booster piston which has a relatively large end face that is subjected to a relatively low pressure and a relatively small end face at which in the pumping stroke an elevated injection pressure prevails, wherein on the side remote from the relatively large end face, because of the difference in size between the two end faces of the booster piston, an idle volume results, this object is attained in that the idle volume is in communication with a cantilevered or offset spring reservoir, which is disposed locally for each individual cylinder or centrally for all the cylinders of the engine. By cantilevering or offsetting the spring, a suitable spring geometry (diameter, length, wire thickness, stiffness) can be selected, thus making it possible to optimize the piston shape and hence other favorable effects (friction minimization, sealing lengths, diameter ratios). Another advantage can arise in a central storage chamber/diaphragm chamber that is common to all the cylinders, because in this case the restoration can be the pressure booster. This can be avoided by means of a suitable pressure limiting valve, which diverts the excess quantity. achieved with only a few additional component parts (in restoration purely via a pilot pressure on the high-pressure side, that pressure would have to be generated first, which would impair the efficiency).

A particular embodiment of the invention is characterized in that the spring reservoir includes a piston which is prestressed by a spring. Although the spring does reduce the maximum injection pressure, this favors fast refilling. In the spring chamber, there is enough installation space for a large spring. Optionally, a small spring can also be disposed in the idle chamber, which further reinforces the refilling.

A further particular embodiment of the invention is characterized in that the spring reservoir includes a prestressed diaphragm. The diaphragm can replace the piston.

If no diaphragm is provided, then because of leakage at the spring chamber piston, a communication between the spring restoration chamber with the leakage must be provided (analogous to the leakage line in the idle chamber of the patent cited) since otherwise the system would block if too much leakage collects behind the spring chamber piston. If a diaphragm is used, a connection to the leakage between the idle volume and the spring reservoir is necessary, since because of the leakage at the pressure booster piston, the quantity of fuel in the idle chamber is not constant, and as the fuel quantity increases, the pressure rises and can block the pressure booster. This can be avoided by means of a suitable pressure limiting valve, which diverts the excess quantity.

In a fuel injection system, in particular a common rail system, having a high-pressure connection, which with at least one injector is in communication with a nozzle chamber, from which fuel is injected into the combustion chamber of an internal combustion engine, the above-stated object is attained in that at an arbitrary point between the high-pressure connection and the nozzle chamber of the injector, there is a pressure booster of the kind described above. The high-pressure connection line can communicate with a high-pressure reservoir, for instance, or can communicate directly with a high-pressure pump. During the injection, the idle volume of the pressure booster is displaced into the spring reservoir.

According to the invention, the displacement work required to displace the fuel outward and aspirate it can be reduced, if the flow losses from friction during aspiration/expulsion are greater compared to leakage. Thus the efficiency can also be improved.

A particular embodiment of the fuel injection system of the invention is characterized in that the pressure booster is integrated with the injector. In a common rail system, the pressure booster can also be integrated with the rail.

In general, such an arrangement can also be used in other injection systems that have a pressure booster of this kind. For instance, in a distributor pump, the 3/2-way valve upstream of the pressure booster can be omitted and replaced by a distributor with a corresponding 2/2-way valve.

BRIEF DESCRIPTION OF THE DRAWING

Further advantages, characteristics and details of the invention will become apparent from the ensuing description, taken in conjunction with the single drawing figure, in which one exemplary embodiment of the invention is described in detail.

DESCRIPTION OF THE PREFERRED EMBODIMENT

In the accompanying drawing, a pressure booster 1 of the invention is shown by way of example. The pressure booster 1 includes a cylinder 2, in which a booster piston 3 is received. The booster piston 3 can reciprocate in the cylinder 2 between a low-pressure side 4 and a high-pressure side 5.

In the context of the present invention, the terms low pressure and high pressure must be considered to be relative. In actuality, high pressure that is made available by a high-pressure pump prevails on the low-pressure side 4. On the high-pressure side 5, in the pumping stroke of the booster piston 3, an elevated injection pressure prevails, which is higher than the high pressure furnished by the high-pressure pump.

The booster piston 3 has two end faces of different sizes. The end face of the booster piston 3 on the low-pressure side 4 is larger than the end face on the high-pressure side 5. As a result, the pressure on the high-pressure side 5 increases when the piston moves from the low-pressure side 4 to the high-pressure side 5.

Two lines 6 and 7 originate at the low-pressure side 4 of the cylinder 2. Via a 3/2-way valve 8, the line 6 can be made to communicate with a high-pressure connection 9 or a pressureless leakage return 10. In the illustrated position of the 3/2-way valve 8, the line 6 communicates with the leakage return 10. In this state, the cylinder 2 fills with fuel on the high-pressure side 5. In the other position of the 3/2-way valve 8, the line 6 communicates via the high-pressure connection 9 with a central high-pressure fuel reservoir (rail). In this state, the pumping stroke takes place, in which the fuel located on the high-pressure side 5 is compressed.

The line 7 communicates, counter to the prestressing force of a spring-prestressed check valve 11, with two lines 12 and 13. The line 12 leads to the high-pressure side 5 of the cylinder 2 and thus assures that upon refilling, fuel from the high-pressure connection 9 can reach the high-pressure side 5.

The line 13 leads to a nozzle chamber 14 of an injector 15. In the injector 15, a nozzle needle 16 is received in a way capable of reciprocation counter to the prestressing force of a nozzle spring 17. When the tip of the nozzle needle 16 lifts from its seat, fuel from the nozzle chamber 14 is injected into the combustion chamber 18 of the internal combustion engine to be supplied.

In order to enable the reciprocating motion of the booster piston 3, an idle volume 20 is provided in the cylinder 2. The idle volume 20 serves, in the pumping stroke, to receive the collar that results from the difference in size of the end faces of the booster piston 3.

The idle volume 20 communicates via a line 21 with a spring reservoir 22. In the spring reservoir 22, a piston 23 is received in a manner capable of reciprocation, counter to the prestressing force of a compression spring 24.

The fuel injection system shown makes improved refilling of the pressure booster 1 possible.

According to the present invention, the compression spring 24 is cantilevered into the spring reservoir 22. In operation of the pressure booster 1 of the invention, the idle volume 20 is expelled into the spring reservoir 22, where it is stored at a defined pressure. The spring reservoir 22 can also be embodied as a diaphragm reservoir.

The sketch shown is intended for the use of a pressure-controlled system. If a stroke-controlled system is used, then it is necessary for the line 7 upstream of the valve 8 to communicate permanently with the line 9, so that the nozzle chamber 14 will permanently be under pressure (if the pressure booster is deactivated, under rail pressure). This kind of stroke-controlled system naturally also requires a pressure reservoir.

What is claimed is:

1. A pressure booster for increasing the injection pressure in direct-injection internal combustion engines with a plurality of cylinders, in particular diesel engines, said booster comprising a booster piston (3) which has a relatively large end face that is subjected to a relatively low pressure and a relatively small end face at which in the pumping stroke an elevated injection pressure prevails, an idle volume space on the side of said booster remote from the relatively large end face resulting from the difference in size between the two end faces of the booster piston (3), said idle volume (20) being connected in communication with a cantilevered spring reservoir (22), disposed locally for each individual cylinder or centrally for all the cylinders of the engine.

2. The pressure booster of claim 1, wherein said spring reservoir (22) includes a piston (23) which is prestressed by a spring (24).

3. The pressure booster of claim 1, wherein said spring reservoir includes a prestressed diaphragm.

4. The pressure booster of claim 2, wherein said spring reservoir includes a prestressed diaphragm.

5. In a fuel injection system, in particular a common rail system, having a high-pressure connection (9), which with at least one injector (15) is in communication with a nozzle chamber (14), from which fuel is injected into the combustion chamber (18) of an internal combustion engine, the improvement comprising a pressure booster (1) of claim 1, disposed at an arbitrary point between the high-pressure connection (9) and the nozzle chamber (14) of the injector (15).

6. The fuel injection system of claim 5, wherein said pressure booster is integrated with the injector or with the high-pressure reservoir.

* * * * *